United States Patent [19]

Sudnishnikov et al.

[11] Patent Number: 4,867,252

[45] Date of Patent: Sep. 19, 1989

[54] SINGLE-STROKE PNEUMATIC APPARATUS

[75] Inventors: Vadim B. Sudnishnikov; Andrei A. Zelentsov, both of Novosibirsk, U.S.S.R.

[73] Assignee: Institut Gornogo Dela Sibirskogo Otdelenia Akademii Nauk SSSR, Novosibirsk, U.S.S.R.

[21] Appl. No.: 239,960

[22] PCT Filed: Oct. 17, 1986

[86] PCT No.: PCT/SU86/00100

§ 371 Date: Jun. 16, 1988

§ 102(e) Date: Jun. 16, 1988

[87] PCT Pub. No.: WO88/02680

PCT Pub. Date: Apr. 21, 1988

[51] Int. Cl.[4] ..... B25D 17/12

[52] U.S. Cl. ..... 173/121; 173/134; 173/DIG. 2; 181/230

[58] Field of Search ..... 173/90, 121, 134, DIG. 2; 181/230

[56] References Cited

U.S. PATENT DOCUMENTS

| | | | |
|---|---|---|---|
| 2,128,742 | 8/1938 | Fuehrer | 173/DIG. 2 X |
| 4,293,045 | 10/1981 | Zeidman et al. | 173/121 |

FOREIGN PATENT DOCUMENTS

| | | | |
|---|---|---|---|
| 755872 | 4/1967 | Canada | 173/DIG. 2 |
| 9529 | 3/1929 | U.S.S.R. . | |
| 671958 | 2/1939 | U.S.S.R. . | |
| 781048 | 11/1980 | U.S.S.R. . | |
| 964129 | 10/1982 | U.S.S.R. . | |

*Primary Examiner*—Frank T. Yost
*Assistant Examiner*—James L. Wolfe
*Attorney, Agent, or Firm*—Lilling & Greenspan

[57] ABSTRACT

A single-stroke pneumatic apparatus incorporates a hollow cylindrical frame (1) with inlet and outlet ports (2,3). A handgrip (4) containing a directional flow control (5) is attached to the upper end of the frame. A striker (6) is provided in the bore of the frame (1) with provision for reciprocating back and forth so as to divide this bore into a forward-stroke chamber (8) a back-stroke chamber (7). A tool (9) is supported in the lower end of the frame (1). A shell (10) with holes (11) surrounds the frame (1) from the outside, forming a muffling chamber (12) therewith, within a full length of the stroke of the striker (6). Additional outlet ports (15) are provided in the lower end of the frame (1) which communicate the back-stroke chamber (8) with the muffling chamber (12) located wherein is a filter (6) overlapping the holes (11) in the shell (10).

1 Claim, 2 Drawing Sheets

SINGLE-STROKE PNEUMATIC APPARATUS

BACKGROUND OF THE INVENTION

Field of the Invention

The present invention relates to pneumatic apparatus of the percussive type used in construction, mining, mechanical engineering and metallurgy and has specific reference to single-stroke pneumatic apparatus.

Description of the Prior Art

Single-stroke pneumatic apparatus commonly employed for marking, centre-pricking, marking-off and chiselling off risers are pneumatic hammers. The tool the hammer is fitted with varies with the application. It can be a stamp, a prick-punch, a hobby or a chisel. The tool is supported in a hollow frame with inlet and outlet ports and a striker dividing the frame bore into forward- and working-stroke chambers. A directional flow control is provided on the frame. The source of energy is compressed air fed from a mobile or stationary compressor over a flexible hose. In operation, the compressed air admitted into the chambers of the frame with the aid of the directional flow control manipulated by the operator, causes the striker to reciprocate back and forth axially and deliver cyclewise blows at the end face of the tool. The work done by the tool materializes in any of the following operations depending on the type of the tool: marking, centre-pricking, chiselling or riveting.

The atmosphere at the working place where pneumatic hammers are in use is commonly laden with dust and the operator cannot but stay in such a surrounding. Therefore, the problem of increasing the reliability of the pneumatic hammer is one of great concern.

Known in the art is a single-stroke pneumatic apparatus (cf. USSR Inventor's Certificate No. 781048, IPC B25D 9/14, 1980) comprising a hollow cylindrical frame provided with inlet and outlet ports, and a striker recurrently interacting with a resilient means located at an end face of the frame. The directional flow control is a solenoid-actuated valve operated by a microswitch. The valve made up of three parts lacking a mechanical link with each other is of intricate design. Apart from that, the known apparatus lacks reliability, for dust and other fine particles are sucked into the bore of the frame through the outlet ports when the striker is on a back stroke. The noisy high-velocity exhaust from the apparatus creates trying labour conditions for the operator.

Also known is a single-stroke pneumatic apparatus, i.e. a pneumatic hammer (cf. German Patent No. 671,958, Cl. 87b 2/11, 1939) comprising a hollow cylindrical frame with inlet and outlet ports, a spring-loaded striker forming forward- and back-stroke chambers in the frame bore, a handgrip located wherein is a directional flow control and a tool fixed in the upper end of the frame.

In the known apparatus, the outlet ports are laid out in a way which cannot prevent ingress of dust-laden atmosphere into the frame bore. Therefore, the hammer cannot last long. The noisy exhaust from the apparatus creates trying labour conditions for the operator.

SUMMARY OF THE INVENTION

It is an object of the invention to provide a single-stroke pneumatic apparatus, in which an enhanced reliability and improvements in the service conditions thereof would be ensured by the design of the air-distribution means.

The invention includes a single-stroke pneumatic apparatus comprising a hollow cylindrical frame with inlet and outlet ports, a handgrip attached to the upper end of the frame, a directional flow control located in the handgrip and used to admit compressed gaseous fluid recurrently into the bore of the frame, a striker located in the bore of the frame with provision for reciprocating back and forth so as to divide the bore of the frame into a forward-stroke chamber—admitted recurrently through the inlet ports is compressed gaseous fluid—and a back-stroke chamber, a return spring fitted to the striker at that end thereof which faces the back-stroke chamber, a tool attached to the lower end of the frame, and a shell with holes which surrounds the frame and forms therewith a muffling chamber communicating with the atmosphere via the holes in the shell and with the back-stroke chamber via the outlet ports. According to the invention the shell extends through a full length of stroke of the striker, the frame is provided at its lower end with additional outlet ports which connect the back-stroke chamber to the muffling chamber and a filter is provided in the muffling chamber which overlays the holes in the shell—located on a level therewith—and serves as a muffler when the stroker displaces towards its lowermost position.

The apparatus of the above design is protected against an ingress of dust and other fine particles into the bore of the frame and therefore lasts longer than any known prior art devices. It also effectively muffles the noise in operation, creating satisfactory labour conditions, owing to the presence of the filter through which gaseous fluid is exhausted.

BRIEF DESCRIPTION OF DRAWINGS

The invention will now be described by way of example with reference to the accompanying drawings in which.

DESCRIPTION OF THE PREFERRED EMBODIMENT

Figure 1:
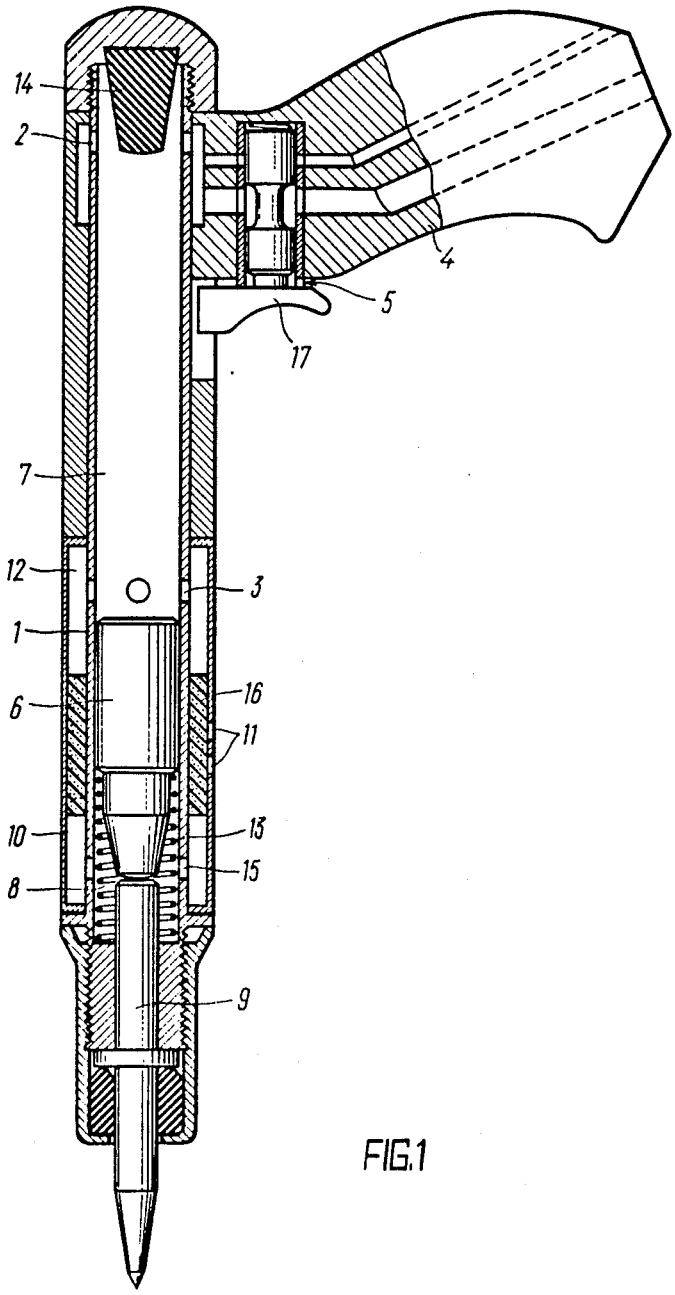
FIG. 1 is a shematic sectional elevation of a single-stroke pneumatic apparàtus according to the invention which illustrates the arrangement of parts at the instant of delivering a blow at the tool.
Figure 2:
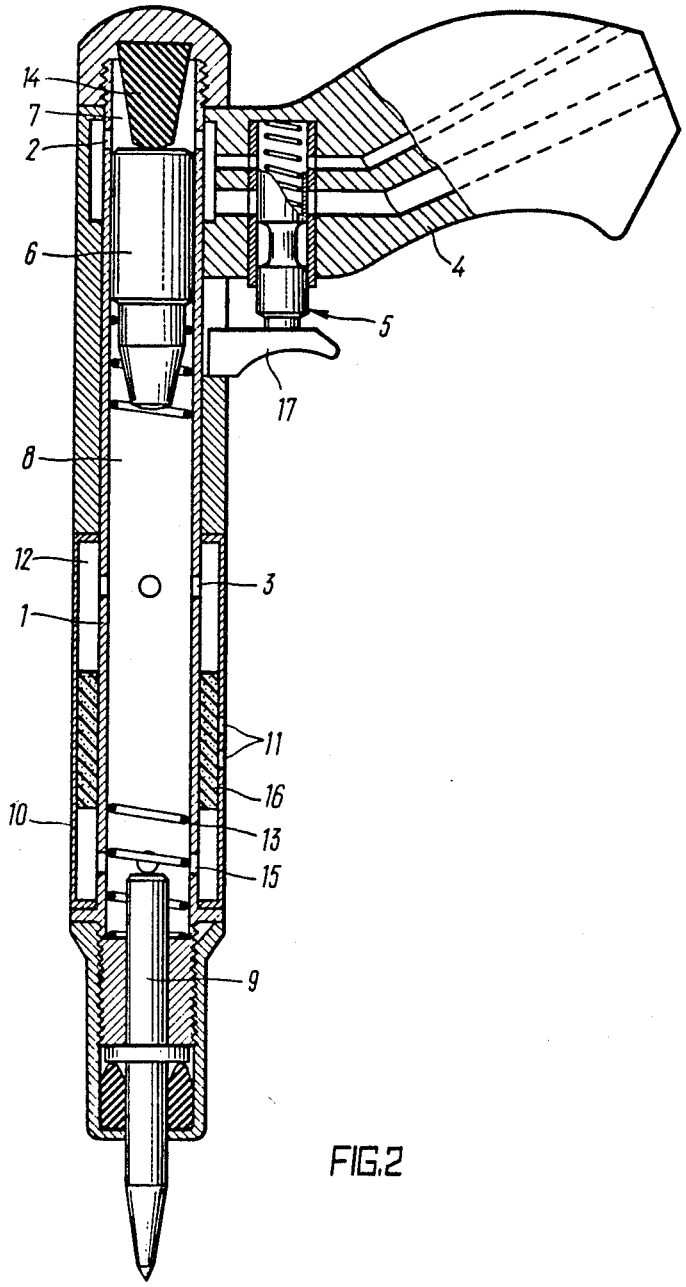
FIG. 2 is a shematic sectional elevation of the apparatus at the instant of a back stroke (the striker is in its topmost position).

Referring to FIGS. 1 and 2, a single-stroke pneumatic apparatus comprises a hollow cylindrical frame 1 with inlet and outlet ports 2, 3. A handgrip 4 is immovably attached to the upper end of the frame 1. A directional flow control 5 is contained inside the handgrip 4. A striker 6 is provided in the bore of the frame 1 with provision for reciprocating back and forth so as to divide the bore of the frame 1 into a forward stroke chamber 7 and a back-stroke chamber 8, and a tool 9 is attached to the lower end of the frame 1. An immovable shell 10 with holes 11 surrounds the frame 1 from the outside all through the length of the striker stroke and forms in the frame a muffling chamber 12 which communicates with the atmosphere via the holes 11 in the shell 10 and with the back-stroke chamber 8 via the outlet ports 3. Mounted in the bore of the frame 1 on the side of the back-stroke chamber 8 are a return spring 13 cooperating with the striker 6 and a shock-absorbing stop 14. Additional outlet ports 15 are provided in the lower end of the frame 1 which connect the back-stroke chamber 8 to the muffling chamber 12, and a filter 16 is provided in the muffling chamber 12 on a level with the holes 11.

The apparatus operates in the following manner.

Compressed gaseous fluid is admitted into the forward-stroke chamber 7 via a union in the handgrip 4 (FIG. 1) the directional flow control 5 and the inlet ports 2 when a trigger 17 is being depressed (FIG. 1). At the said time, the back-stroke chamber 8 is connected to the atmosphere via the outlet ports 3, the additional outlet ports 15, the muffling chamber 12, the filter 16 and the holes 11. The striker 6 is acted upon by the compressed gaseous fluid in the forward-stroke chamber 7 travels downwards against the action of the return spring 13, whereby the gaseous fluid contained in the back-stroke chamber is expelled into the muffling chamber 12 through the additional outlet ports 15 and hence into the atmosphere via the filter 16 and the holes 11. As soon as the top edge of the travelling striker 6 uncovers the outlet ports 3, the gaseous fluid contained in the forward-stroke chamber 7 escapes into the atmosphere through the outlet ports 3, the filter 16 and the holes 11. At this stage, the filter 16 functions as the muffler. Continuing on the down stroke, the striker 6 delivers a blow at the end face of the tool 9 in contact with the work, causing it to do the job. The outlet ports 3 relieve the striker 6, and consequently the tool 9, of a continuing pressure which may cause the tool 9 to bounce, losing contact with the work. The flow section and number of the outlet ports 3 should be selected so that the pressure buildup in the forward-stroke chamber 7 is higher than the maximum force of the compressed return spring 13. Otherwise the apparatus will not function.

When the trigger 17 is released, no compressed gaseous filud enters the forward stroke chamber 7 and this becomes connected to the atmosphere via the outlet ports 2 and the directional flow control 5. As the striker 6 is returned into the topmost position due to the action of the return spring 13, air is sucked into the back-stroke chamber 8 through the holes 11, the filter 16, the muffling chamber 12 and the additional outlet ports 15. The filter 16 separates dust from the air, keeping the dust outside the back-stroke chamber 8.

The disclosed apparatus compares favourably with the known single-stroke pneumatic apparatus in that it prevents ingress of dust and other fine particles inside the frame and operates at a significantly lower noise level.

These advantages add 10–15% to the apparatus' reliability and improve labour conditions.

The invention can be used to advantage in coping with such jobs as marking and marking-off, centre-pricking, riveting and chiselling off risers.

It may also be of utility in trimming roofs of mine openings, punching holes, breaking concrete and other civil engineering applications.

What is claimed is:

1. A single-stroke pneumatic apparatus comprising a hollow cylindrical frame (1) with inlet and outlet ports (2,3), in an upper end of which frame a handgrip (4) is fixed, accommodating a directional air control (5) for periodic admission of a compressed gaseous medium into a bore (1) in the frame, in which bore a striker (6) is disposed with provision for recirprocation, said striker dividing said bore into a forward-stroke chamber, periodically communicated via the inlet ports (2) with the compressed gaseous medium, and a back-stroke chamber (8), and a tool (9) mounted in a lower end of the frame (1), on which frame a shell (10) with holes (11) is arranged, said shell forming with the frame (1) a muffling chamber (12), communicating through the holes (11) in the shell (10) with the atmosphere and through the outlet ports (3) with the back-stroke chamber (8), from which chamber the striker (6) is spring-loaded with respect to the frame (1), characterized in that the shell (10) is provided all through the length of the stroke of the striker (6), and in that additional outlet ports (15) are provided in the lower end of the frame (1), communicating the back-stroke chamber (8) with the muffling chamber (12), in which chamber (12) a filter (16) is disposed level with the holes (11) in the shell (10), said filter (16) overlapping said holes (11) and acting as a muffler as the striker (6) travels to its lower-cost position.

* * * * *